US005184776A

United States Patent [19]

Minier

[11] Patent Number: 5,184,776

[45] Date of Patent: Feb. 9, 1993

[54] PNEUMATIC ATOMIZER

[75] Inventor: Jacques Minier, Talant, France

[73] Assignee: Commissariat a l'Energie Atomique, France

[21] Appl. No.: 757,812

[22] Filed: Sep. 11, 1991

[30] Foreign Application Priority Data

Sep. 27, 1990 [FR] France ..... 90 11932

[51] Int. Cl.[5] ..... B05B 7/02; B05B 12/10

[52] U.S. Cl. ..... 239/417; 239/434.5; 239/DIG. 19

[58] Field of Search ..... 239/417, 434.5, 583, 239/DIG. 19, 459

[56] References Cited

U.S. PATENT DOCUMENTS

| | | | |
|---|---|---|---|
| 955,938 | 4/1910 | Ballentine | 239/434.5 |
| 1,693,101 | 11/1928 | Worthington . | |
| 2,198,998 | 4/1940 | Honsberger | 239/417 |
| 3,034,726 | 5/1962 | Péras | 239/434.5 X |
| 3,111,271 | 11/1963 | Löfgren | 239/583 X |
| 3,380,705 | 4/1968 | Enssle | 239/583 X |
| 4,688,724 | 8/1987 | Pal et al. | 239/434.5 X |
| 4,941,614 | 7/1990 | Ilott | 239/459 X |

OTHER PUBLICATIONS

Davies et al, "An Adjustable Atomizer for Atomic Absorption Spectroscopy," Journal of Scientific Instruments, vol. 42, pp. 816, 817.

*Primary Examiner*—Andres Kashnikow
*Assistant Examiner*—William Grant
*Attorney, Agent, or Firm*—Kerkam, Stowell, Kondracki & Clarke

[57] ABSTRACT

A pneumatic atomizer includes a gas flow circuit forming the carrier for a liquid to be atomized. The liquid flows through a capillary terminating in a cone spaced from a narrow passage through which the gas and liquid sweep. The capillary and the cone are axially mobile to stabilize the gas flow rate. The atomizer is useful for determining the composition of the liquid by emission spectrometry.

6 Claims, 2 Drawing Sheets

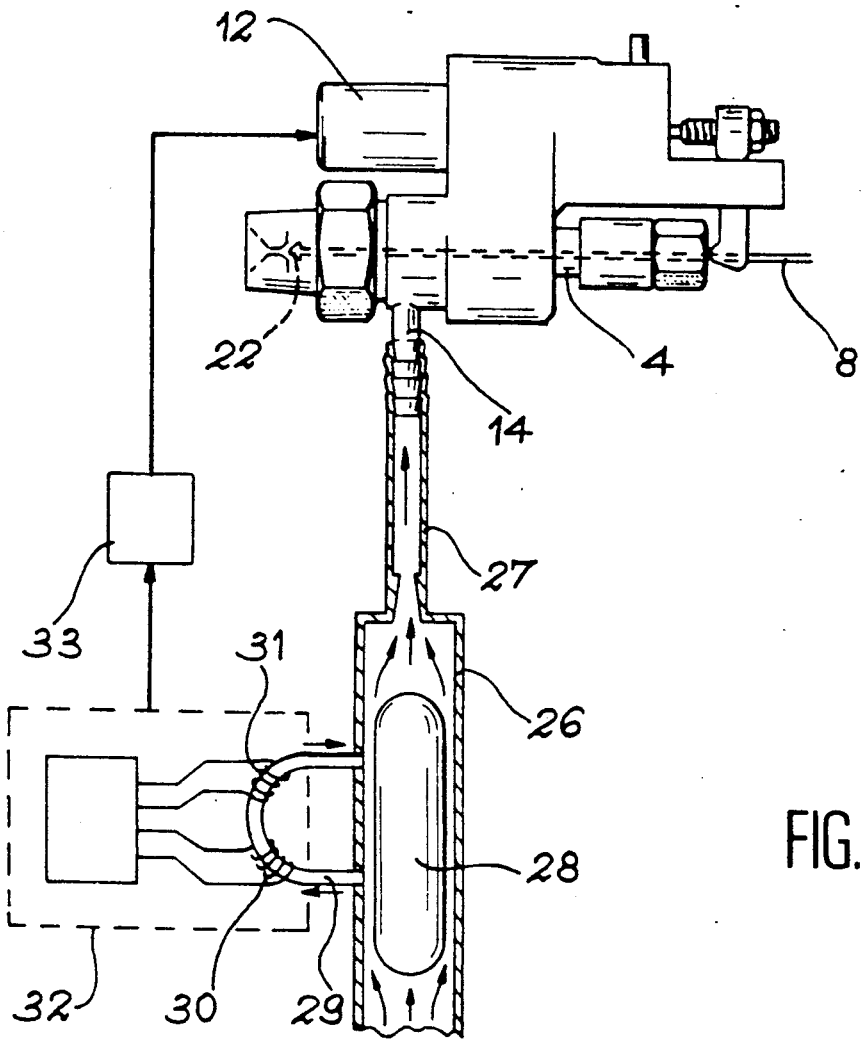
FIG. 3
FIG. 2
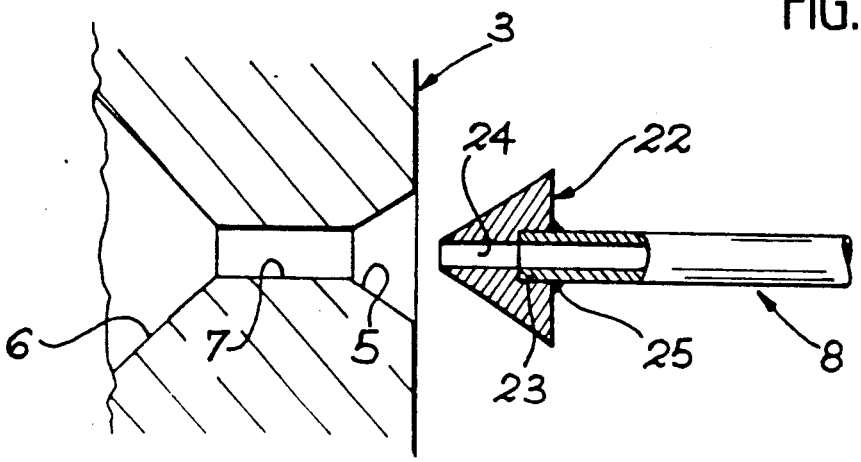

PNEUMATIC ATOMIZER

BACKGROUND OF THE INVENTION

The invention relates to a pneumatic atomizer.

Atomizers make it possible to break down a liquid into droplets and mix it with a carrier gas so as to obtain an aerosol. Such a transformation is necessary for the analysis of liquids in emission spectrometry. Pneumatic atomizers are one of the main categories and are based on the utilization of the Venturi effect. The liquid is injected into the carrier gas by the end of a capillary terminated in a chamber traversed by the gas and the mixture then passes into a constriction where the pressure drops significantly and atomization takes place. However, it has been found that it is difficult to obtain a stable efficiency of the installation. The liquid concentration of the aerosol varies significantly over a period of time, essentially due to the temperature variations caused by the pressure drop, which leads to contractions of components of the atomizer. However, it is still possible to obtain an aerosol having a constant composition by regulating a gas flow rate control valve, but the adjustments must be continuous because the composition obtained is never stable. Moreover, the atomizers have a poor efficiency, i.e. the aerosol contains little liquid.

SUMMARY OF THE INVENTION

These two disadvantages are eliminated or at least reduced as a result of the invention, which relates to an atomizer comprising a liquid supply capillary terminated in a chamber traversed by a gas flow and in front of a constriction or narrowing of the chamber and which is characterized in that the capillary is terminated by a cone tapered towards the narrowing and with an opening identical to a conical cavity at the entrance to the narrowing, the cone and the conical cavity being coaxial to the capillary and that the capillary is fixed to a mobile part in the capillary axis.

The combination of the cone and the conical cavity improves the flow characteristics and in particular its efficiency. The effect can be reinforced if the capillary is made from a malleable material such as platinum, for reasons which will be explained hereinafter.

The capillary advantageously has a separated or bared portion close to the cone and which slides in a centring device bearing on a wall defining the chamber.

BRIEF DESCRIPTION OF THE DRAWINGS

The invention is described in greater detail hereinafter relative to non-limitative embodiments and the attached drawings, wherein show:

FIG. 2 A larger scale view of the end of the capillary.

FIG. 3 The measuring system.

DETAILED DESCRIPTION OF THE INVENTION

Figure 1:
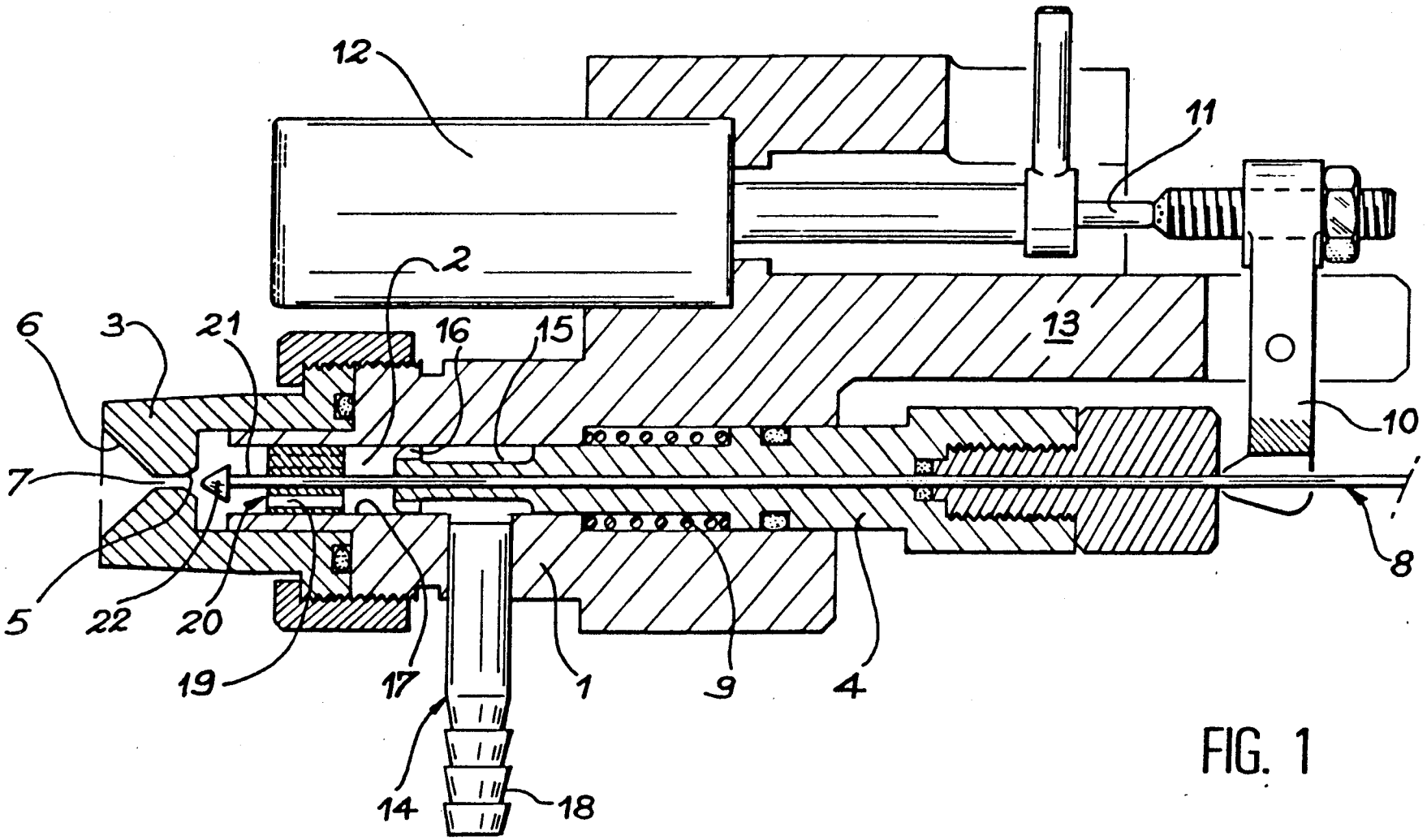
FIG. 1 An overall view of the basic components of the atomizer.

The atomizer shown in FIG. 1 firstly comprises a tubular body 1 used for defining a flow chamber 2. The flow chamber 2 is also bounded at its two ends by a pressure relief valve 3 and a moving piston 4. The pressure relief valve 3 is constructed in such a way as to have a conical cavity 5, which issues by its widened portion into the chamber 2, an outlet conical cavity 6 widening towards the outside and an expansion pipe 7 joining the two conical cavities 5 and 6.

The piston 4 is cylindrical and its axis is perforated so as to receive a capillary 8 integral therewith. A spring 9 is compressed between shoulders of the body 1 and the piston 4 in order to move the latter towards the right in accordance with the representation of the drawing. However, a lever 10 bears by one end on the piston 4 and prevents any exaggerated displacement thereof in this direction by exerting an abutment action thereon. Thus, the movement of the lever 10 is controlled by a rod 11 sliding under the action of a controlled motor 12. The rod 11 is coaxial to the shaft of the motor 12 and is connected thereto by a known, not shown device, such as a nut and screw system for converting the rotary movement of the motor shaft into a translatory movement of the rod 11. The body 1 and the motor 12 are rigidly fixed to a frame 13 on which the lever 10 pivots.

There is a radial passage towards the centre of the body 1 in which is inserted a gas pipe coupling 14. The coupling 14 leads to the chamber 2 in front of a thickness reduced portion 15 of the piston 4, which has the advantage of not obstructing the radial passage. Pins 16 project from the thickness reduced portion 15 up to the inner cylindrical wall of the body 1, which defines the chamber 2, for centring the piston 4. The end of the coupling 14 opposite to the tube 1 is provided with conical grooves 18 on its outer face in order to firmly receive a flexible tube supplying the chamber 2 with carrier gas. The gas passes out of the chamber 2 by the passage 7. It traverses passages 19 located on a ring-shaped centring device 20, which has a central passage in which slides a portion 21 of the capillary 8, which is disengaged from the piston 4. The centring device 20 bears on the cylindrical wall 17 and therefore keeps the capillary 8 coaxial to the conical cavity 5 at the inlet of the expansion pipe 7. The capillary 8 is terminated in front of the conical cavity 5 by a cone 22, which tapers towards it and has the same aperture. It is illustrated in greater detail in FIG. 2.

The cone 22 has an axial pipe, whereof a portion 23 contiguous with the base of the cone 22 has an adequate diameter to receive the end of the capillary 8, whilst the remainder 24 of the pipe has the internal diameter of the capillary 8. The capillary 8 is made from platinum and the cone 22 from rhodium-containing platinum. They are rigidly assembled by hard soldering with gold 25.

The liquid to be broken down into an aerosol is introduced into the capillary 8 from the right of FIGS. 1 and 2 towards the expansion pipe 7 and also freely traverses the cone 22 in order to spread in the chamber 2 close to the conical cavity 5. It is then swept along and collected by the gas passing round the cone 22. Cooperation between the conical cavity 5 and the cone 22 limits turbulence and makes the flow regular, which assists the trapping of the liquid by the carrier gas. The mixture which undergoes atomization in the expansion pipe 7 consequently has a high liquid content (efficiency), which is several times that obtained in the prior art atomizers. Therefore gas consumption is reduced.

A possible source of disturbance is the misalignment of the capillary 8 relative to the expansion pipe 7. The existence of the centring device 20 reduces this risk, but without completely eliminating it. Thus, use can be made of the cone 22 for bringing about a perfect centring. The piston 4 and the capillary 8 are then moved in such a way as to penetrate the cone 22 in the conical cavity 5 until contact is made with the latter. The capillary 8 is bent until a perfect centering is obtained and, as the platinum forming it is a malleable material, it plastically deforms so as to maintain the alignment of the cone 22 with the conical cavity 5, even when these two elements have been separated. The choice of rhodium-containing platinum for the cone 22 gives it a greater hardness, which protects its surface.

FIG. 3 diagrammatically shows the device controlling the motor 12 as a function of the carrier gas flow rate. The gas passes through a rigid tube 26 and then a flexible tube 27, which is set around conical grooves 18 before reaching the coupling 14. On a longitudinal portion the rigid tube 26 contains an ingot 28, which serves as an obstacle and only allows the passage of gas over a small annular section. A loop pipe 29 is connected by its two ends to said annular section and an invariable proportion of the gas flow rate passes through it. Two coils 30 and 31 are wound around the loop pipe 29 at different locations and forms two resistors of a Wheatstone bridge 32, which is connected to the control circuit 33 of the motor 12.

As the gas is at a different temperature from that of the external medium, the modification of the gas flow rate through the passage 7 and through the loop pipe 29 leads to different variations of the temperatures and therefore the resistances of the coils 30 and 31. The Wheatstone bridge 32 is unbalanced, which leads to the starting up of the control circuit 33 of the motor 12, so as to displace the piston 4 and the capillary 8 in order to bring the gas flow to its intended value by facilitating or impeding the flow due to the cone 22, whose displacement modifies the free section for the passage of the carrier gas. Regulating the gas flow rate by the sliding of the capillary 8 instead of by a valve makes it easier to place the motor and measuring members remote from the atomizer, which is located in a corrosive area in a certain number of applications.

Experience has shown that the adjustments and settings obtained with the invention were relatively stable, i.e. corrections were less numerous and less significant, unlike in the prior art means.

I claim:

1. Atomizer comprising a capillary in which liquid to be atomized flows, the capillary having a conical end, the conical end being lodged in a chamber in which atomizing gas flows, the chamber being connected to a narrowed outlet bore through a conical cavity, the conical end and the conical cavity being coaxial to an axis, having a same aperture and tapering towards the outlet bore, the liquid flowing out of the capillary directly past the conical end and into the chamber or the conical cavity and the capillary being fixed to a part moving along the axis.

2. Atomizer according to claim 1, characterized in that the capillary is made from a malleable material.

3. Atomizer according to claim 2, characterized in that the malleable material is platinum.

4. Atomizer according to claim 3, characterized is that the cone is made from rhodium-containing platinum.

5. Atomizer according to claim 1, wherein the chamber bears a device for centering the capillary in the chamber, the capillary sliding in the centering device, the conical end being comprised between the centering device and the narrowed outlet.

6. Atomizer according to claim 1, wherein a spring urges the moving part on a control device against which for moving the moving part, the control device including means for sensing a temperature of the atomizing gas.

* * * * *